US005620376A

United States Patent [19]

Hsu

[11] Patent Number: 5,620,376

[45] Date of Patent: Apr. 15, 1997

[54] GOLF SWING TRAINING DEVICE

[76] Inventor: Kevin Hsu, 11610 Inwood, Houston, Tex. 77077

[21] Appl. No.: 601,330

[22] Filed: Feb. 16, 1996

[51] Int. Cl.[6] ..... A63B 69/36

[52] U.S. Cl. ..... 473/233; 473/237

[58] Field of Search ..... 273/186.4; 473/237, 473/233

[56] References Cited

U.S. PATENT DOCUMENTS

| | | | |
|---|---|---|---|
| D. 244,630 | 6/1977 | Krawagna | D21/2 |
| D. 294,619 | 3/1988 | McCallister | D21/234 |
| D. 308,998 | 7/1990 | Cates | D21/234 |
| 2,804,306 | 8/1957 | Chedister | 273/186 |
| 3,037,777 | 6/1962 | Chedister et al. | 473/237 X |
| 3,350,101 | 10/1967 | Bishop et al. | 273/186 |
| 3,687,459 | 8/1972 | Swords | 273/186 |
| 3,958,362 | 5/1976 | Kessler | 46/7 |
| 3,992,012 | 11/1976 | Campbell | 273/186 R |
| 4,693,479 | 9/1987 | McGwire | 273/186 A |
| 4,911,450 | 3/1990 | Rabold | 273/186 A |
| 5,165,683 | 11/1992 | Beutler et al. | 273/35 R |
| 5,210,603 | 5/1993 | Sabin | 358/93 |
| 5,236,192 | 8/1993 | Pitzel | 273/186.2 |
| 5,273,278 | 12/1993 | Becker | 273/29 A |
| 5,297,796 | 3/1994 | Peterson | 273/183.1 |
| 5,470,071 | 11/1995 | Hsu et al. | 273/186.4 |

*Primary Examiner*—George J. Marlo
*Attorney, Agent, or Firm*—Harrison & Egbert

[57] ABSTRACT

A golf swing training device including a shaft, a club head connected to an end of the shaft, and a liquid-receiving chamber having an inlet and an outlet orifice. The outlet orifice is of a sufficient size so as to release a liquid by capillary action during a swing of the shaft. The chamber is affixed to the shaft such that the outlet orifice is adjacent to a bottom of the heel of the club head. The chamber is detachably affixed to the shaft. The outlet orifice has a diameter of between 0.3 mm and 0.5 mm. The outlet orifice has a length of ¾ inch or more. A clamp member is connected to the chamber and extends outwardly therefrom. This clamp member detachably engages the shaft. A flange portion extends between the chamber and the clamp portion such that the chamber resides at an acute angle relative to a longitudinal axis of the shaft.

18 Claims, 1 Drawing Sheet

GOLF SWING TRAINING DEVICE

TECHNICAL FIELD

The present invention is related in general to the field of golf swing practice and training devices. More particularly, the present invention is related to golf swing training devices that allow the golfer to almost instantaneous evaluate his or her swing.

BACKGROUND ART

Golfers continuously strive for the perfect swing to achieve an accurate and powerful drive that sends the ball a long distance in a straight line toward the target green or hole. To realize this goal, golfers typically engage in practice and exercise sessions to improve their technique and to increase the strength and muscle memory used in various techniques. Golfers may simply practice their swings in the back yard or they may utilize a place designed especially for practicing, such as a driving range. Similarly, they may simply practice with their regular golf clubs or they may use some sort of club or other device specially designed for practice and exercise. A wide variety of devices have been developed for the purpose of training the golf swing of the golfer.

U.S. Pat. No. 2,804,306, issued on Aug. 27, 1957 to C. Chedister et al. describes a swing indicator for a golf club. This swing indicator includes a clamp which extends between the shaft of the golf club and is attached to a liquid-containing chamber. The liquid-containing chamber is maintained in parallel relationship to the longitudinal axis of the golf club shaft. The liquid-receiving chamber includes a valve which extends interior of the chamber so as to release liquid during a swing of a golf club. An outlet orifice is positioned at a bottom end of the chamber so as to deposit the liquid upon the earth during the swing of the golf club. The outlet orifice is positioned adjacent to the top and rear of the club head. The structure and interior configuration of the chamber is quite complicated and is expensive to assemble. Additionally, the action of the valve makes the transmission of any liquid through the outlet orifice an uncertain action. The valve must work perfectly, in accordance with the swing characteristics of the golfer, so as to assure that the liquid passes through the outlet orifice.

In the past, various patents have issued relating to devices for training the swing of a golfer. U.S. Pat. No. 3,350,101 issued on Oct. 31, 1967, to Bishop et al. teaches a golf swing practice device having a pad with a tee area and a simulated captive ball member therein. A curved line represents the ground trace of the swing of the club extending to the tee area. A resilient upright member is wound on a reel for vertical adjustment located along this line and represents a vertical point on the swing path of the club.

U.S. Pat. No. 3,687,459, issued on Aug. 29, 1972, to H. L. Swords describes a golf swing testing attachment which includes a bracket that can be attached to the head of a golf club and which carries a pair of spaced markers of different colors. These markers will mark an underlying sheet of paper when a practice swing is made. The relative locations of the marks indicate the nature of defects in the user's swing.

U.S. Pat. No. 3,992,012, issued on Nov. 16, 1976, to I. R. Campbell describes a device for analyzing the swing of a golf club. This device has a base with a ball support area. Side spin detectors are located above the base with their free ends adjacent the ball support area for contact by a club head as it passes over the ball support area in a swing.

U.S. Pat. No. 4,693,479, issued on Sep. 15, 1987, to R. P. McGwire describes a self-contained detachable device for selective attachment to a golf club to provide a visual indication of the position of the golf club during the swing. A cylindrical housing, which has a light bulb attached thereto, provides a directed beam of light extending outwardly from the housing. The light beam provides illumination of a well-defined path over the surface surrounding the golf ball during the back swing and the forward swing.

U.S. Pat. No. 4,911,450, issued on Mar. 27, 1990, to B. Rabold shows a device used to teach and practice a golf swing. This device includes a short shaft having a club head on one end and a grip on the other end. A grip end light is mounted in the grip to produce a light that is co-linear with the longitudinal axis of the shaft. A club head light is mounted in the club head to provide a light that is directly below the club head bottom edge and is oriented at ninety degrees to the bottom edge of the club head so that the club head light is located centrally between the heel and toe directly beneath the club head. A swing track includes paths to be traversed by the grip end light and the club head light during the various phases of the golf swing.

U.S. Pat. No. 5,165,683, issued on Nov. 24, 1992, to Beutler et al. shows a golf swing training device that includes a blade having a sufficient width and rigidity to generate air resistance during a representative swing motion. This blade is designed to fold during the upswing motion and to flatten during the downswing motion.

U.S. Pat. No. 5,210,603, issued on May 11, 1993, to D. C. Sabin provides a portable battery-operated video camera and recorder system that allows one to make a video recording of a golf swing.

U.S. Pat. No. 5,236,192, issued on Aug. 17, 1993, to B. H. Pitzel shows a golf swing training device that comprises a club shaft, one end having a grip and the other end having a generally C-shaped member to which a removable flat panel is attached. The training club is swung like a standard club and is used to simulate striking a ball with a square face, without the use of a golf ball. Because of its size, the panel provides a visible indication of the position of the club in the hands of the user so as to allow the user to make immediate adjustments in the course of the swing.

U.S. Pat. No. 5,273,278, issued on Dec. 28, 1993, to R. Becker describes a golf club having an audio feedback device to provide an audible indication of the speed of movement of the club.

U.S. Pat. No. 5,297,796, issued on Mar. 29, 1994, to J. R. Peterson discloses a visual monitoring system for a golfer to simultaneously watch his golf swing while the swing is being made. One or more video cameras and video monitoring screens are mounted below a transparent surface where the swing is being made with a golf club for viewing the swing without distorting the head of the golfer during the golf swing.

It is an object of the present invention to provide a golf swing training device that provides immediate feedback of the swing path.

It is another object of the present invention to provide a golf swing training device that enhances the ability of the golfer to correct his or her swing by comparing the swing to an ideal swing path.

It is another object of the present invention to provide a golf swing training device that enhances the "muscle memory" of the golfer.

It is another object of the present invention to provide a golf swing training device that is portable, easy to use, economical, and suitable for indoor and/or outdoor practice.

It is a further object of the present invention to provide a golf swing training device that reduces the need for golfing instructors.

It is still another object of the present invention to provide a golf swing training device in which the pattern of the golf swing can be made by simple capillary action of water passing through a tube without the need for complicated valving arrangements.

It is still a further object of the present invention to provide a golf swing training device in which a pattern of liquid droplets is released, as close as practical, to the bottom of the heel of the club head.

These and other objects and advantages of the present invention will become apparent from a reading of the attached specification and appended claims.

SUMMARY OF THE INVENTION

The present invention is a golf swing training device that comprises a shaft, a club head connected to an end of the shaft, and a liquid-receiving chamber having an outlet orifice. The outlet orifice is of a sufficient size so as to release a liquid by capillary action during a swing of the shaft. The chamber is affixed to the shaft such that the outlet orifice is adjacent a bottom of the club head.

The chamber is detachably affixed to the shaft. The outlet orifice opens at a heel of the club head. The outlet orifice is positioned at a bottom of the liquid-receiving chamber. The outlet orifice has an opening in planar alignment with a bottom of the club head. The chamber has a clamp member extending outwardly therefrom This clamp member detachably engages the shaft. The clamp member includes a flange portion extending outwardly therefrom toward the liquid-receiving chamber. The chamber is at an acute angle relative to the shaft.

The orifice has a diameter of between 0.3 millimeters and 0.5 millimeters. The orifice also has a length of greater than ¾ inch between the outlet of the orifice and the liquid-receiving chamber. The chamber can include water or a colorless chemical. The liquid-receiving chamber and the outlet orifice are arranged in valveless fluid communication. A cap member is detachably affixed to an end of the liquid-receiving chamber opposite the outlet orifice. This cap member is attached in liquid-tight relationship to the chamber.

DETAILED DESCRIPTION OF THE INVENTION

Figure 1:
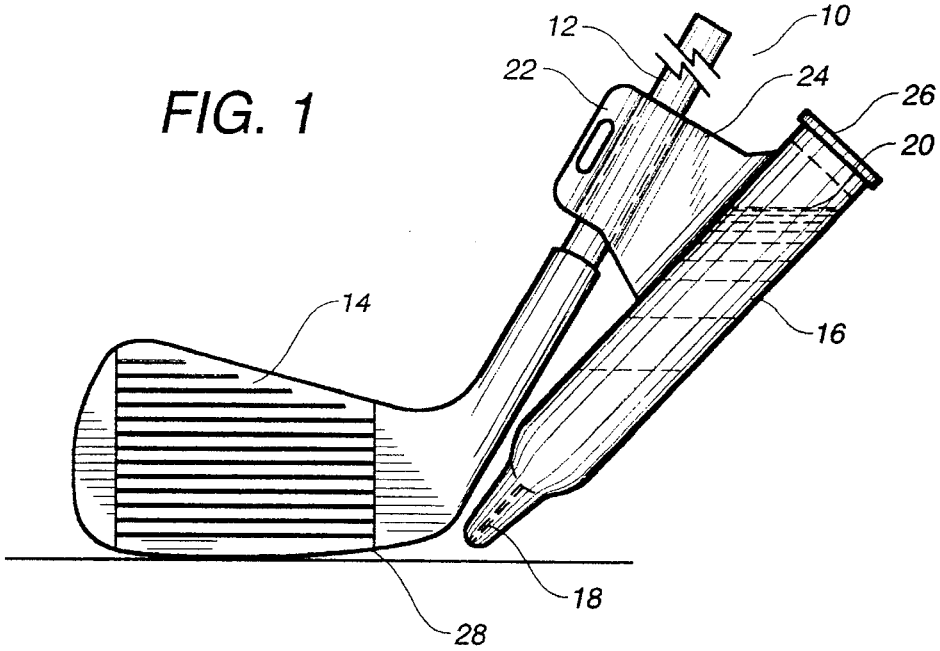
FIG. 1 is a side elevational cross-sectional view of the golf swing training device of the present invention.

Referring to FIG. 1, there is shown at 10 the golf swing training device in accordance with the preferred embodiment of the present invention. The golf swing training device 10 includes a shaft 12, a club head 14, and a liquid-receiving chamber 16. The liquid-receiving chamber 16 includes an outlet orifice 18 positioned at a bottom of the liquid-receiving chamber 16. A liquid 20 is contained within the interior of the liquid-receiving chamber. The outlet orifice 18 is configured such that the liquid 20 of the liquid-receiving chamber 16 can pass outwardly therethrough by capillary action. In particular, the outlet orifice 18 should have a sufficient size so as to release a liquid during a swing of the shaft. As can be seen, the chamber 16 is affixed to the shaft 12 such that the outlet orifice 18 is adjacent to the bottom of the club head 14.

It can be seen in FIG. 1 the liquid-receiving chamber 16 includes a clamp 22 that is secured around the circumference of the shaft 12. A flange portion 24 extends from the clamp 22 to the liquid-receiving chamber 16. The configuration of the clamp 22, the flange portion 24, and the liquid-receiving chamber 16 assures that the liquid-receiving chamber 16 extends at an acute angle relative to the longitudinal axis of the shaft 12. The outlet orifice 18 will be positioned, as close as possible, to the longitudinal axis of the shaft 12. The opposite end 26 of the liquid-receiving chamber 16 is positioned further away from the longitudinal axis of the shaft 12 than that of the outlet orifice 18. In this manner, the outlet orifice 18 can be positioned, as closely as possible, to the heel of the club head 14 at the bottom 28 of the club head 14.

As can be seen in FIG. 1, the golf swing training device 10 is clamped onto the shaft 12 at the heel side of the club head 14. This will allow the liquid markings from the water passing through the outlet orifice 18 to be in line with the club face. The angular clamping position of the chamber 16 relative to the shaft 12 serves to bring the trace of water left on the ground or display mat closer to the actual sweet spot of the club head 14. The configuration of the clamping device of the present invention will allow the golf swing training device 10 to fit any size or shape of golf club. Unlike prior art devices, the present invention puts the liquid markings in line with the club face. The present invention, importantly, requires no valves for the operation of the outlet orifice 18. The phenomenon of capillary adhesion between the liquid and the long fine tube of the outlet orifice 18 serves to control the flow of the liquid 20 through the outlet orifice 18. As a result, the cost of constructing the golf swing training device 10 of the present invention is much less than prior art devices. Additionally, since the passing of liquid through the outlet orifice 18 is governed by the laws of physics, the operation of the golf swing training device 10 is virtually infallible.

Figure 2:
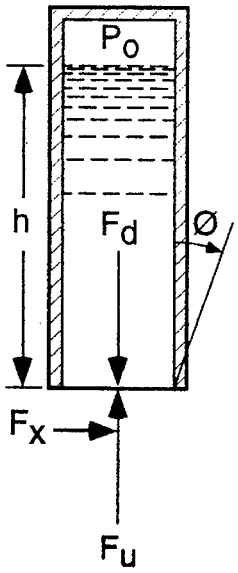
FIG. 2 is an enlarged cross-sectional view of the configuration of the outlet orifice of the chamber of the present invention, showing the physical characteristics which provide for the capillary action of the liquid passing through the chamber.

Referring to FIG. 2, the operation of the capillary movement of the liquid through the outlet orifice is illustrated with greater detail. In tubes having very small diameter, liquid will interact with the wall of the tubes. As shown in the following two equations, if the total force down $F_d$ is less than or equal to the force up $F_u$ caused by the surface tension of liquid, the liquid remains in the tube. If $F_d$ is larger than $F_u$, then the liquid surface tension will break.

$$F_d = P_oA + \rho ghA + F_x \quad (1)$$

$$= \pi R^2 (P_o + \rho gh) + F_x$$

$$F_u = 2\pi R\gamma\cos\phi \quad (2)$$

where $F_d$=total force down $F_u$=force up by surface tension $P_o$=1.013×10 N/m (atm. pressure)

$\rho$=density of liquid g=9.8 m/s (acceleration of gravity)

$F_x$=other forces $\phi$=angle of contact $\gamma$=surface tension

In the present Invention, by properly clamping the device 10 onto the shaft 12, the other force $F_x$ will be mainly the centrifugal force generated from the golf swing. At the address position or at low speeds (i.e. during the backswing), there is zero or low centrifugal force. As a result, the device will hold the liquid interior of the outlet orifice 18 in the manner of a closed valve. However, during the acceleration of the forward swing, the larger centrifugal force is added to the total down force $F_d$ so as to break the balance. As a result, liquid will be emitted from the bottom of the outlet orifice 18 and will leave a visible swing trace accordingly. The flow of liquid will be proportional to the swing speed.

The diameter of the outlet orifice is very critical in the present invention. From the above two equations, it is noted that:

As a result, by decreasing the radius R of the tube, the downward force will be decreased more than the upward force. In the present invention, small diameters of tubes between 0.3 mm to 0.5 mm have been found suitable for this application. When tubes of this diameter are used, water will be retained without leaking outwardly therefrom at the address position and at the low swing speeds.

The length of the tube is also very important. Since the rate of flow of liquid in a round tube depends not only on the viscosity of the liquid and the pressure differential, but also on the dimensions of the tube. This in shown in Poiseuille's equation as follows:

$$Q=\pi R^4(p_1-p_2)/8\eta L$$

In this equation, R is the inside radius of the tube, L is its length, $p_1-p_2$ is the pressure differential between the ends, $\eta$ is the viscosity and Q is the volume rate of the flow. In the present invention, small tubes with a length longer than ¾ inch have been found to be suitable. Shorter lengths of tubes will cause water to leak out too quickly and will cause dispersion. As a result, a less distinguishable swing trace would be formed.

In summary, using the physical phenomenon of liquid in a selected length of a small diameter tube, a natural valve is created in the present invention so as to control the flow of the marking droplets and to leave a visible swing trace. The construction of the present invention is much more economical and more practical than complicated devices found in the prior art.

Figure 3:
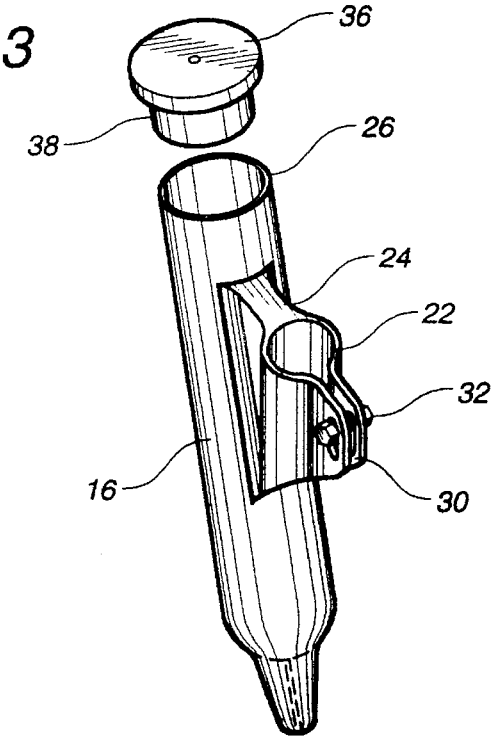
FIG. 3 is a perspective exploded view of the clamp and chamber of the golf swing training device to a golf club.

FIG. 3 shows an exploded perspective view of the liquid-receiving chamber 16 and the clamp 22. In FIG. 3, it can be seen that the clamp 22 has a generally C-shaped configuration. The opening 30 of the C-shaped configuration is in a direction away from the liquid-receiving chamber 16. A high strength plastic or steel screw 32 is provided in an end of the C-shaped configuration of the clamp 22 so as to allow the clamp 22 to be appropriately tightened around the circumference of the shaft 12 of a golf club. The screw 32 can have a wingnut, or other device, attached to an end thereof so as to facilitate the ability to attach the clamp 22 to the shaft 12. As can be seen in FIG. 3, the clamp 22 has a longitudinal axis which extends at an acute angle relative to the longitudinal axis of the liquid-receiving chamber 16. This angled relationship is created by the flange portion 24 which extends between the clamp member 22 and the liquid-receiving chamber 16. The liquid-receiving chamber 16, the flange portion 24, and the clamp member 22 can be integrally formed together.

A cap member 36 is insertable into the top 26 of the chamber 16. The cap 36 should have a size and configuration so as to properly seal the interior of the chamber 16 in a liquid-tight manner. A rubber sleeve 38 can be affixed to the inserted portion of the cap 36 so as to assure a tight seal. The chamber 16 and the cap 36 can be made of a transparent or semi-transparent high-strength plastic.

In actual use, when the golfer swings the golf club, the droplets from the golf swing training device 10 will be distributed across the surface of the earth (or a mat) in accordance with the path of the swing of the golf club, and its associated head. The centrifugal force imparted by the swinging of the shaft of the golf club will cause droplets to be emitted through the outlet orifice 18 of the chamber 16 of the golf swing training device 10.

After an initial swing, the golfer is able to see the path of his or her swing. The pattern of droplets will be clearly visible to the golfer. At this point, the golfer can evaluate the desired swing or can evaluate how to correct the swing. When the golfer takes another swing, the golfer will be able to easily compare the droplets emitted through the second swing with the droplets that were emitted with the first swing. As such, the golfer can accurately compare swing motions. This comparison can be carried out in an immediate fashion.

The foregoing disclosure and description of the invention is illustrative and explanatory thereof. Various changes in the details of the illustrated configuration may be made within the scope of the appended claims without departing from the true spirit of the invention. The present invention should only be limited by the following claims and their legal equivalents.

I claim:

1. A golf swing training device comprising:

a shaft;

a club head connected to an end of said shaft; and a liquid-receiving chamber having an outlet orifice, said outlet orifice means in valveless fluid communication with said chamber, said outlet orifice means for releasing a liquid by and only by capillary action from said chamber, said chamber affixed to said shaft such that said outlet orifice means is positioned adjacent a bottom of said club head.

2. The device of claim 1, said chamber detachably affixed to said shaft, said outlet orifice means opening at a heel of said club head.

3. The device of claim 2, said outlet orifice means positioned at a bottom of said liquid-receiving chamber, said outlet orifice means having an opening in planar alignment with a bottom of said club head.

4. The device of claim 1, said chamber having a clamp member extending outwardly therefrom, said clamp member detachably engaging said shaft.

5. The device of claim 4, said clamp member having a flange portion extending outwardly therefrom toward said liquid-receiving chamber, said chamber being at an acute angle relative to a longitudinal axis of the shaft.

6. The device of claim 5, said chamber and said clamp member being integrally formed together, said outlet orifice means positioned so as to be below said clamp member.

7. The device of claim 1, said outlet orifice means having an orifice with a length of greater than ¾ inch between an outlet of said orifice and said liquid-receiving chamber.

8. The device of claim 1, further comprising:

a liquid contained within said chamber, said liquid being water or a colorless chemical having a viscosity of water.

9. The device of claim 1, said liquid-receiving chamber having a cap member detachably affixed thereto in liquid-tight relationship.

10. A golf swing training device comprising:

a shaft;

a club head connected to an end of said shaft;

a liquid-receiving chamber having an outlet orifice, said outlet orifice in valveless fluid communication with said chamber, said orifice having a diameter of between 0.3 millimeters and 0.5 millimeters, said orifice having a length of greater than ¾ inch between an outlet of said orifice and said liquid-receiving chamber; and a liquid contained within said chamber, said liquid being water or a colorless chemical with a viscosity of water.

11. A golf swing training device comprising:

a chamber having an outlet orifice means, said outlet orifice means for allowing drops of a liquid having a viscosity of water to pass therethrough by and only by capillary action, said outlet orifice means positioned at a bottom of said chamber, said outlet orifice means being in valveless fluid communication with said chamber; and a means for attaching said chamber to a shaft of a golf club.

12. The device of claim 11, said chamber having a liquid-receiving interior, said outlet orifice means having an orifice extending from a bottom of said liquid-receiving interior.

13. The device of claim 11, said orifice having a diameter of between 0.3 millimeters and 0.5 millimeters.

14. The device of claim 13, said orifice having a length of greater than ¾ inch.

15. The device of claim 11, said orifice having a length of greater than ¾ between an outlet of said outlet orifice and said chamber.

16. The device of claim 11, said means for attaching comprising a clamp member, said clamp member having a generally C-shaped configuration with a size suitable for extending around a portion of a circumference of the shaft, said clamp member having means for tightening the attachment of the clamp onto the shaft.

17. The device of claim 16, said clamp member having a flange portion extending between said clamp member and said chamber such that said chamber resides at an acute angle relative to a longitudinal axis of said clamp member.

18. The device of claim 17, said outlet orifice means having an outlet positioned adjacent a longitudinal axis of said clamp member.

* * * * *